US008438694B2

(12) United States Patent
Kim et al.

(10) Patent No.: US 8,438,694 B2
(45) Date of Patent: May 14, 2013

(54) CLEANING APPARATUS

(75) Inventors: Dong Won Kim, Hwaseong-si (KR); Hwi Chan Jang, Suwon-si (KR); Jae Man Joo, Suwon-si (KR); Jun Pyo Hong, Suwon-si (KR); Jun Hwa Lee, Suwon-si (KR); Woo Ram Chung, Seoul (KR); Jae Young Jung, Suwon-si (KR); Kyung Hwan Yoo, Incheon-si (KR); Jang Youn Ko, Gwangju (KR); Jeong Gon Song, Gwangju (KR); Sam Jong Jeung, Gangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 344 days.

(21) Appl. No.: 12/801,309

(22) Filed: Jun. 2, 2010

(65) Prior Publication Data

US 2011/0010873 A1 Jan. 20, 2011

Related U.S. Application Data

(60) Provisional application No. 61/213,569, filed on Jun. 19, 2009.

(30) Foreign Application Priority Data

Aug. 18, 2009 (KR) ..... 10-2009-0076068

(51) Int. Cl.
*A47L 5/00* (2006.01)

(52) U.S. Cl.
USPC ..... 15/319; 15/347

(58) Field of Classification Search ..... 15/319, 15/339, 340.1, 347; *A47L 5/00, 7/00, 9/10, A47L 9/20; B08B 5/00*
See application file for complete search history.

(56) References Cited

U.S. PATENT DOCUMENTS

| | | | | |
|---|---|---|---|---|
| 2005/0217042 | A1* | 10/2005 | Reindle | 15/41.1 |
| 2005/0229340 | A1* | 10/2005 | Sawalski et al. | 15/50.3 |
| 2006/0293809 | A1* | 12/2006 | Harwig et al. | 701/23 |
| 2007/0157415 | A1* | 7/2007 | Lee et al. | 15/319 |
| 2008/0047092 | A1* | 2/2008 | Schnittman et al. | 15/319 |
| 2008/0148512 | A1* | 6/2008 | Beskow et al. | 15/350 |
| 2008/0201895 | A1* | 8/2008 | Kim et al. | 15/319 |

* cited by examiner

*Primary Examiner* — Brian Glessner
*Assistant Examiner* — Brian D Mattei
(74) *Attorney, Agent, or Firm* — Staas & Halsey LLP

(57) ABSTRACT

A cleaning apparatus including a main body, a dust collection unit detachably installed on the main body and provided with a plurality of inlets, through which foreign substances are introduced into the dust collection unit, and a connection hole, to which an external instrument is connected, a shutter to open and close one inlet, and a cap to open and close the connection hole. The shutter opens and closes the inlet in cooperation with one of whether or not the dust collection unit is attached to or detached from the main body and whether or not the connection hole is opened or closed.

18 Claims, 6 Drawing Sheets

CLEANING APPARATUS

CROSS-REFERENCE TO RELATED APPLICATIONS

This application claims the benefit of U.S. patent application Ser. No. 61/213,569, filed on Jun. 19, 2009 in the USPTO and Korean Patent Application No. 2009-076068, filed on Aug. 18, 2009 in the Korean Intellectual Property Office, the disclosures of which are incorporated herein by reference.

BACKGROUND

1. Field

Embodiments relate to a cleaning apparatus which prevents foreign substances from pouring out of a dust collection unit through an inlet of the dust collection unit.

2. Description of the Related Art

In general, cleaning apparatuses are apparatuses which remove foreign substances, such as dust, from a floor to be cleaned. Among the cleaning apparatuses, there is a robot cleaner which cleans a designated area while autonomously traveling without user manipulation.

The robot cleaner includes a main body, a dust collection unit to collect foreign substances, wheels installed on the lower surface of the main body so as to allow the robot cleaner to perform cleaning while traveling, and a brush unit to sweep foreign substances accumulated on a floor to the inside of the dust collection unit through an inlet provided on the dust collection unit.

The dust collection unit is detachably installed on the main body, and, if a proper amount of foreign substances are collected in the dust collection unit, the dust collection unit is separated from the main body so as to easily remove the foreign substances from the inside of the dust collection unit.

If the dust collection unit is carelessly separated from the main body, the foreign substances collected in the dust collection unit may pour out of the dust collection unit through the inlet. Thus, the dust collection unit needs to be carefully separated from the main body.

SUMMARY

Therefore, it is an aspect to provide a cleaning apparatus which prevents foreign substances from pouring out of a dust collection unit through an inlet of the dust collection unit during a process of separating the dust collection unit from a main body.

It is another aspect to provide a cleaning apparatus which effectively removes foreign substances from the inside of a dust collection unit through an external instrument.

Additional aspects will be set forth in part in the description which follows and, in part, will be aparent from the description, or may be learned by practice of the invention.

In accordance with one aspect, a cleaning apparatus includes a main body, a dust collection unit detachably installed on the main body and provided with a plurality of inlets, through which foreign substances are introduced into the dust collection unit, and a connection hole, to which an external instrument is connected, a shutter to open and close one inlet, a cap to open and close the connection hole, and guides to guide opening and closing of the inlet by the shutter in cooperation with one of whether or not the dust collection unit is attached to or detached from the main body and whether or not the connection hole is opened or closed.

The shutter may be hinged to one side of the inlet of the dust collection unit, and may be rotated to open and close the inlet.

The cleaning apparatus may further include interlocking levers, each of which is provided with one end connected to the shutter and the other end having an interlocking protrusion guided by each guide, rotated together with the shutter, and a guide plane inclined in a direction of attaching and detaching the dust collection unit to and from the main body to guide the interlocking protrusion may be provided on each guide.

The cap may be provided with one end hinged to the dust collection unit, and may be rotated to open and close the connection hole.

The guides may be rotatably installed on the main body, and may be rotated to support the interlocking protrusions.

The cleaning apparatus may further include pressure members, each of which is provided with one end connected to a cap hinge shaft provided on the cap, rotated together with the cap to apply pressure to the guides so as to rotate the guides.

The cleaning apparatus may further include restoring springs installed on guide hinge shafts to rotatably install the guides on the main body, and restoring the guides to their original positions.

A reception recess to receive and support the interlocking protrusion guided by the guide plane may be provided at one side of the guide plane of each guide.

The dust collection unit may include a first storage part to collect relatively large foreign substances, a second storage part to collect relatively small foreign substances, a first inlet through which foreign substances are introduced into the first storage part, and a second inlet through which foreign substances are introduced into the second storage part, and the shutter may open and close the first inlet.

The dust collection unit may further include a support protrusion provided at the lower end of the first inlet to support the lower end of the shutter and to guide, in cooperation with the shutter, air, introduced into the first storage part through the first inlet, to the lower portion of the first storage part.

In accordance with another aspect, a cleaning apparatus includes a main body, a dust collection unit detachably installed on the main body and provided with a plurality of inlets, through which foreign substances are introduced into the dust collection unit, and a connection hole, to which an external instrument is connected, a cap to open and close the connection hole, and a shutter to open and close one inlet in cooperation with the cap.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
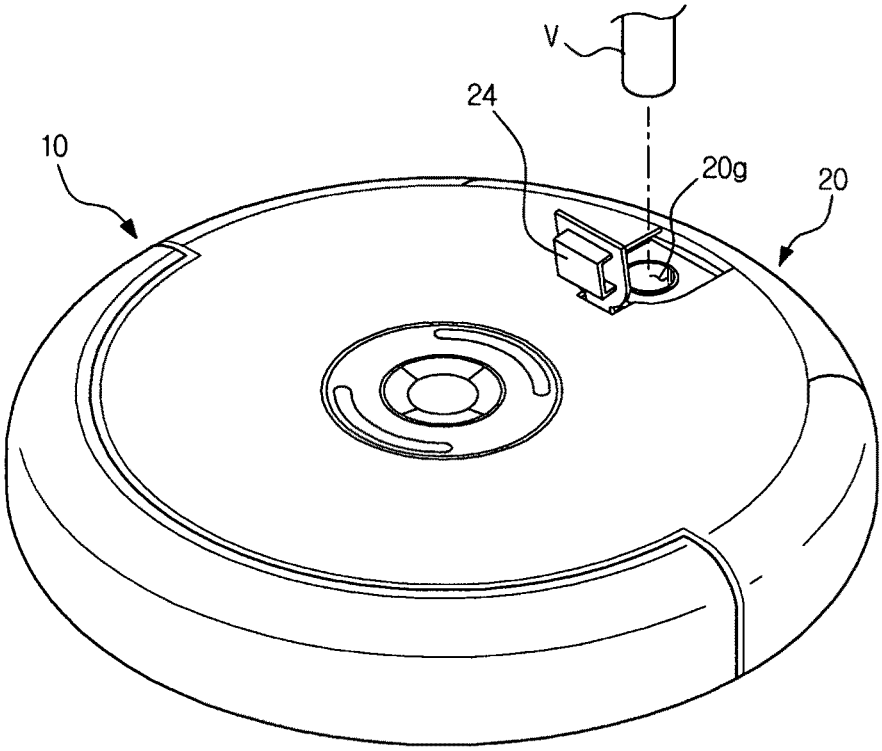
FIG. 1 is a perspective view of a cleaning apparatus in accordance with one embodiment.

Reference will now be made in detail to the embodiments, examples of which are illustrated in the accompanying drawings, wherein like reference numerals refer to like elements throughout.

Figure 2:
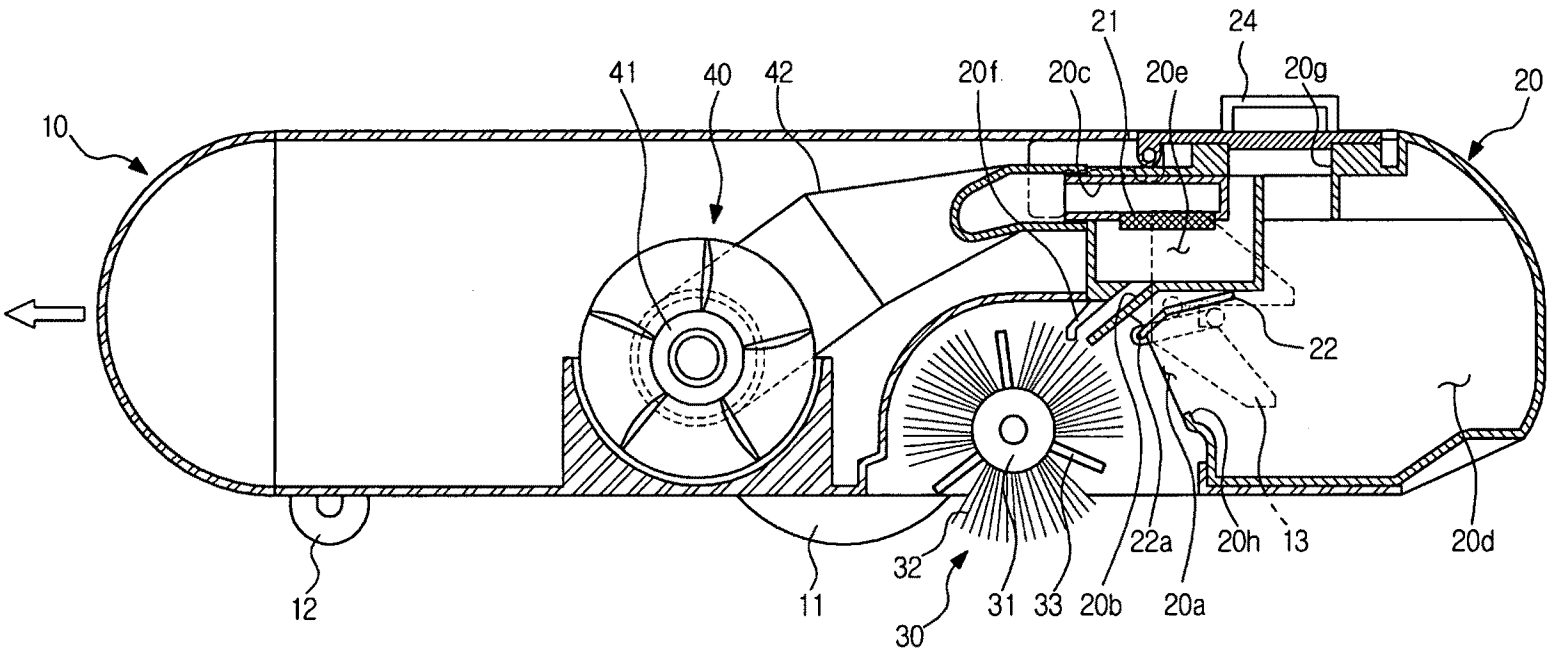
FIG. 2 is a longitudinal-sectional view of the cleaning apparatus in accordance with the embodiment.

As shown in FIGS. 1 and 2, a cleaning apparatus 1 in accordance with one embodiment includes a main body 10 forming an external appearance of the cleaning apparatus 1, a dust collection unit 20 separably installed on the main body 10 to collect foreign substances, a brush unit 30 to sweep foreign substances on a floor to the inside of the dust collection unit 20, and an air blower unit 40 to allow small particles of the foreign substances, which are suspended upwardly by the brush unit 30, to be sucked into the dust collection unit 20. A plurality of wheels 11 and 12 to allow the cleaning apparatus 1 to perform cleaning while autonomously traveling is installed at both sides of the lower surface of the main body 10.

Figure 3:
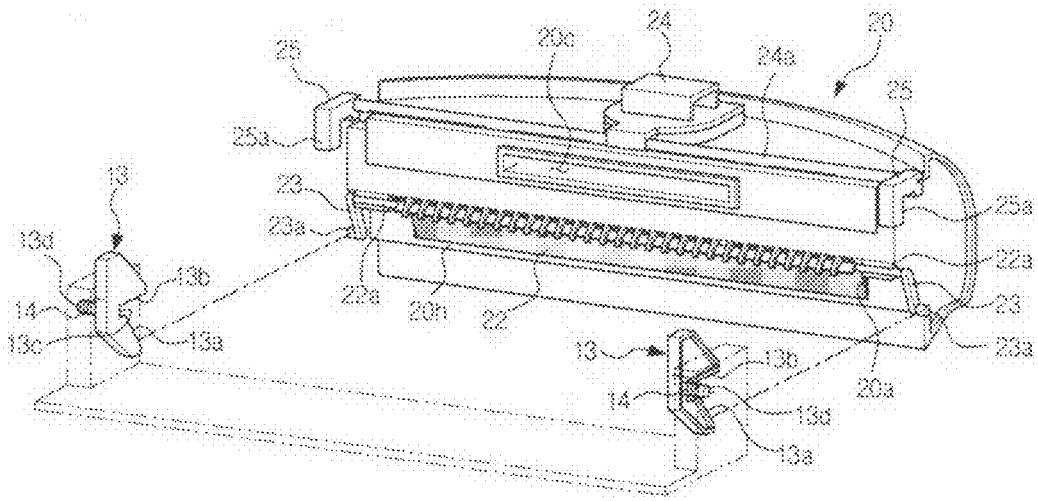
FIG. 3 is a perspective view of a dust collection unit applied to the cleaning apparatus in accordance with the embodiment.

The dust collection unit 20, as shown in FIGS. 2 and 3, is provided with a pair of inlets 20*a* and 20*b*, through which dust is introduced into the dust collection unit 20, formed at one side thereof. The inlets 20*a* and 20*b* includes a first inlet 20*a*, through which the foreign substances swept by the brush unit 30 are introduced into the dust collection unit 20, and a second inlet 20*b*, through which suspended particles of the foreign substances are introduced into the dust collection unit 20 together with air, provided above the first inlet 20*a* in parallel with the first inlet 20*a*. A transmission hole 20*c*, through which the air introduced into the dust collection unit 20 through the second inlet 20*b* is discharged to the air blower unit 40, is provided through the dust collection unit 20. Further, the inner space of the dust collection unit 20 is divided into a first storage part 20*d* connected with the first inlet 20*a* such that relatively large particles of the foreign substances are mainly collected in the first storage part 20*d*, and a second storage part 20*e* connected to the second inlet 20*b* and the transmission hole 20*c* such that relatively small particles of the foreign substances are mainly collected in the second storage part 20*e*. A filter 21 to filter out the foreign substances from the air so as to allow the obtained clean air to be transmitted to the air blower unit 40 through the transmission hole 20*c* is disposed in the second storage part 20*e*.

The brush unit 30 includes a roller 31 rotated by rotary force transmitted from a driving motor (not shown) installed in the main body 10, brushes 32 made of an elastic material and implanted in the roller 31 so as to be protruded outwardly in the radial direction of the roller 31, and flaps 33 made of an elastic material to increase a diameter of the brush unit 30 on which foreign substances, such as hair are wound. The brush unit 30 is rotated and sweeps relatively large particles of foreign substances on the floor to the inside of the first storage part 20*d* of the dust collection unit 20 through the first inlet 20*a*. A brush cleaning member 20*f* extended toward the brush unit 30 in the shape of a comb to remove the foreign substances wound on the brushes 32 is formed at one side of the second inlet 20*b* of the dust collection unit 20.

The air blower unit 40 is installed in front of the brush unit 30. The air blower unit 40 includes an air blower fan 41 rotated by the rotary force transmitted from the driving motor (not shown), and a suction channel 42 connected with the dust collection unit 20 to transmit suction force generated from the air blower fan 41 to the dust collection unit 20. The small particles of the foreign substances suspended from the floor by the brush unit 30 are inhaled to the inside of the second storage part 20*e* of the dust collection unit 20 through the second inlet 20*b*.

The wheels 11 and 12 include a pair of traveling wheels 11 disposed at both sides of the lower surface of the main body 10 in parallel, and a caster wheel 12 disposed at a front part of the lower surface of the main body 10.

Further, a shutter 22 to prevent the foreign substances collected in the dust collection unit 20 from pouring out of the dust collection unit 20 through the first inlet 20*a* is installed at one side the first inlet 20*a* of the dust collection unit 20. A shutter hinge shaft 22*a* to hinge the shutter 22 to the front part of the first inlet 20*a* is formed at one end of the shutter 22, and the other end of the shutter 22 is extended to the inside of the first storage part 20*d* through the first inlet 20*a*. A support protrusion 20*h* supporting the lower end of the shutter 22 entering the first storage part 20*d* through the first inlet 20*a* to rotate the shutter 22 toward the inside of the first storage part 20*d* is formed at the lower end of the first inlet 20*a* of the dust collection unit 20.

Therefore, as the dust collection unit 20 is attached to or detached from the main body 10, the shutter 22 is rotated around the shutter hinge shaft 22*a* within the first storage part 20*d* in cooperation with the attachment of the dust collection unit 20 to the main body 10 or the detachment of the dust collection unit 20 from the main body 10, and the lower end of the shutter 22 is supported by the support protrusion 20*h* or is separated from the support protrusion 20*h*, thereby opening or closing the first inlet 20*a*.

Further, as shown in FIGS. 1 and 2, the dust collection unit 20 is configured such that the foreign substances collected in the dust collection unit 20 are removed from the dust collection unit 20 without separation of the dust collection unit 20 from the main body 10. For this purpose, a connection hole 20*g* to which an external instrument V, such as a vacuum cleaner, is connected is formed through the upper surface of the dust collection unit 20. The connection hole 20*g* is connected to the first storage part 20*d* and the second storage part 20*e* respectively such that all the foreign substances collected in the first storage part 20*d* and the second storage part 20*e* are inhaled to the external instrument V through the connection hole 20*g*. A cap 24 to selectively open the connection hole 20*g* only if the external instrument V needs to be connected to the connection hole 20*g* is installed on the connection hole 20*g*. A cap hinge shaft 24*a* to allow the cap 24 to be rotatably installed on the upper surface of the dust collection unit 20 is provided at one end of the cap 24, and thus the cap 24 is hinged to the upper surface of the dust collection unit 20 through the cap hinge shaft 24*a* and is rotated to open and close the connection hole 20*g*.

Here, the shutter 22 opens and closes the first inlet 20*a* according to whether or not the dust collection unit 20 is attached to or detached from the main body 10 and whether or not the connection hole 20*g* is opened or closed. For this purpose, guides 13, to guide rotation of the shutter 22 according to attachment and detachment of the dust collection unit 20 to and from the main boy 10 and to guide rotation of the shutter 22 according to opening and closing of the connection hole 20*g* by the cap 24, are installed on the main body 10, and interlocking levers 23, each of which is provided with one end connected to the shutter hinge shaft 22*a* and the other end guided by each guide 13, are installed on the shutter 22, thereby rotating the shutter 22 together with rotation of the interlocking levers 23 according to rotation of the interlocking levers 23 guided by the guides 13.

Here, a pair of interlocking levers 23 is provided. One end of each interlocking lever 23 is connected to each of both ends of the shutter hinge shaft 22*a*, such that the interlocking levers 23 are rotated together with rotation of the shutter 22, and an interlocking protrusion 23*a* which is guided by the guide 13 so as to allow the interlocking lever 23 to be rotated around the shutter hinge shaft 22*a* is protruded horizontally from the other end of each interlocking lever 23.

Each of the guides 13 includes a guide plane 13*a* inclined in a direction of attaching and detaching the dust collection unit 20 to and from the main body 10 to guide the interlocking protrusion 23*a* and thus to guide rotation of the interlocking lever 23 and the shutter 22 to which the interlocking lever 23 is connected, a support plane 13*b* provided to form a V shape together with the guide plane 13*a* such that the interlocking protrusion 23*a* moving along the guide plane 13*a* is supported by the support plane 13*b*, and a reception recess 13*c* formed between the guide plane 13*a* and the support plane 13*b* such that the interlocking protrusion 23*a* is seated in and supported by the reception recess 13*c*.

With reference to FIG. 3 again, the shutter 22 is rotated together with the cap 24 under the condition that the dust collection unit 20 is installed in the main body 10, thereby opening and closing the first inlet 20*a*. That is, if the cap 24 is rotated and thus opens the connection hole 20*g*, the first inlet 20 is closed, and if the cap 24 closes the connection hole 20*g*, the first inlet 20*a* is opened. This prevents suction force, transmitted from the external instrument V, from being transmitted to the outside of the dust collection unit 20 through the first inlet 20*a* at more than a proper level, and simultaneously allows air inhaled through the first inlet 20*a* to pass through the first storage part 20*d* with a sufficient velocity, thereby causing the foreign substances in the first storage part 20*d* to be effectively removed.

In order to rotate the shutter 22 in cooperation with the cap 24, the guides 13 are rotatably installed in the main body 10, and pressure members 25, each of which is provided with one end connected to the cap hinge shaft 24*a* so as to be rotated together with the cap 24 and to rotate the guides 13, are provided on the dust collection unit 20.

A guide hinge shaft 13*d* is protruded integrally from a portion of each guide 13 adjacent to the reception hole 13*c*, thereby rotatably installing each guide 13 on the main body 10. A pressure part 25*a* latched to each guide 13 according to rotation of the pressure member 25 to transmit force to the guide 13 is formed on the other end of each pressure member 25. Further, a restoring spring 14 including a torsion spring is installed on the guide hinge shaft 13*d*, thereby restoring the guide 13 to its original position if the force applied to the guide 13 through the pressure member 25 is released.

Hereinafter, an operation of the above cleaning apparatus will be described in detail with reference to the accompanying drawings.

Figure 4:
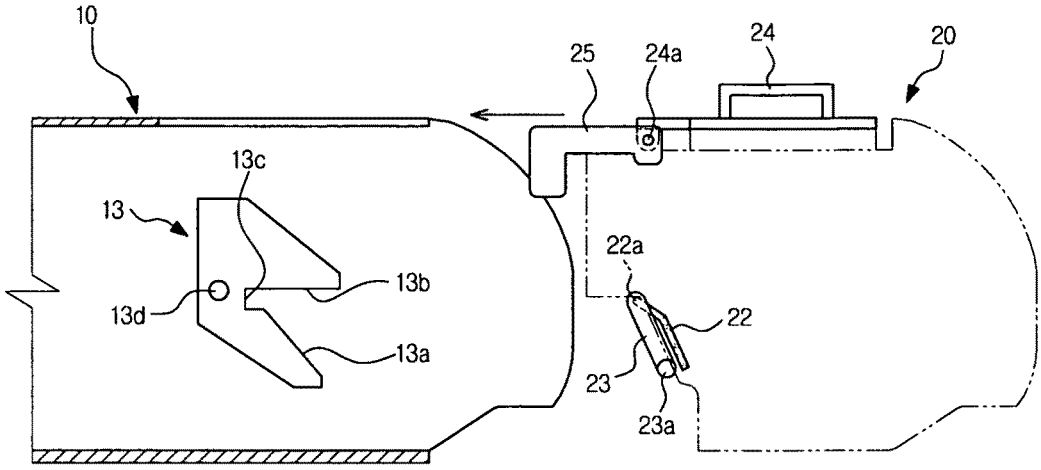
FIGS. 4 to 6 are schematic views illustrating an operation of a shutter applied to the cleaning apparatus in accordance with the embodiment.
Figure 5:
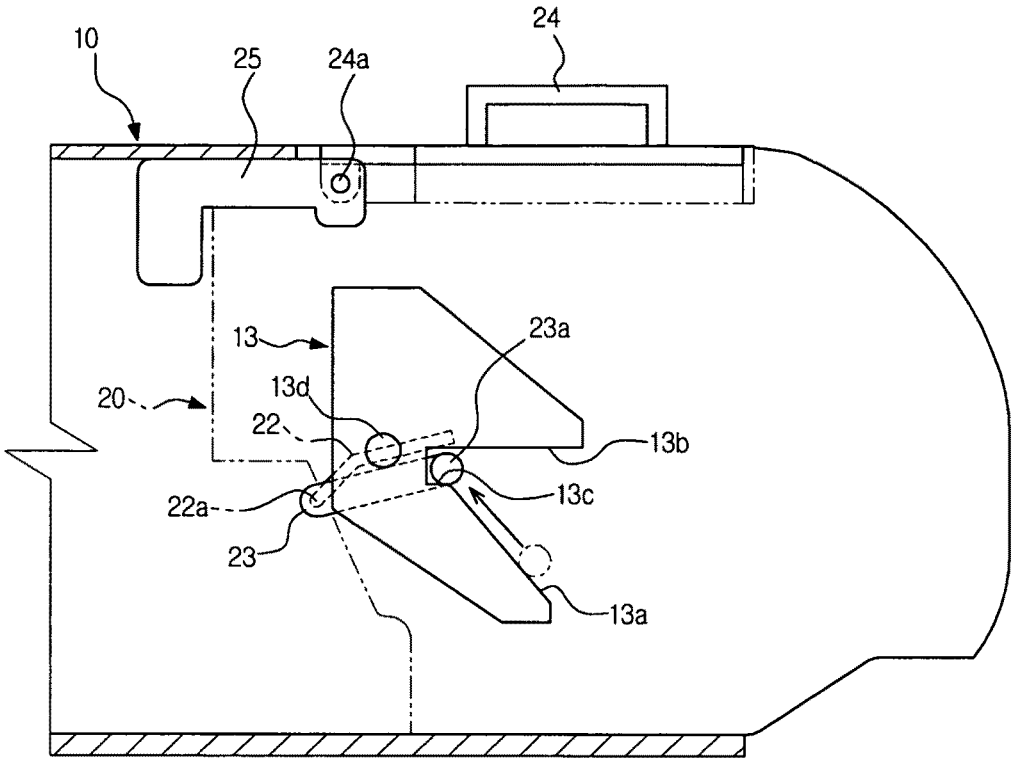

Under the condition that the dust collection unit 10 is separated from the main body 10, as shown in FIG. 4, the first inlet 20*a* maintains a closed state thereof by the shutter 22. Then, when the dust collection unit 10 is connected to the main body 10, as shown in FIG. 5, the interlocking protrusions 23*a* contact the guide planes 13*a* and move to the reception recesses 13*c* along the guide planes 13*a*. Thereby, the shutter 22 is rotated together with the interlocking levers 23 connected to the shutter hinge shaft 22*a*, thus opening the first inlet 20*a*.

Figure 6:
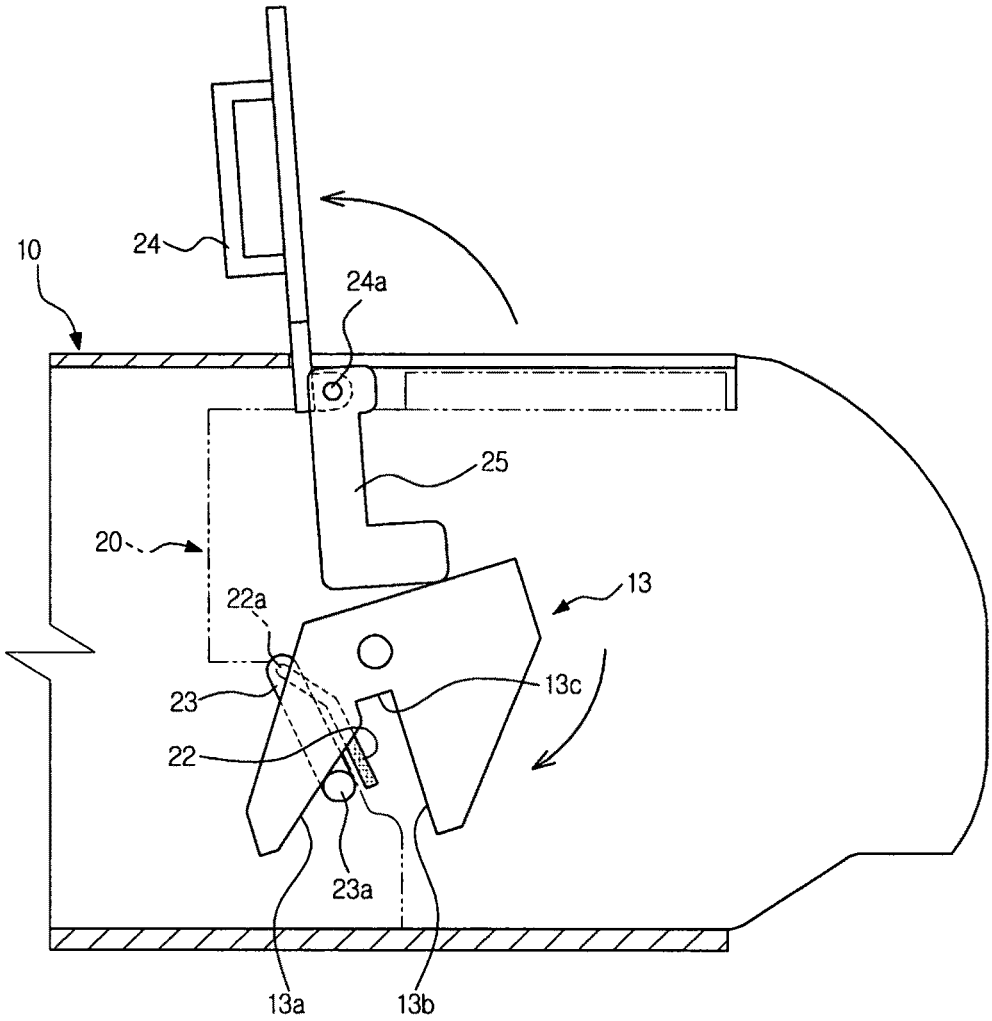

Further, if opening of the connection hole 20*g* to remove the foreign substances collected in the dust collection unit 20 is required, when the cap 24 is rotated so as to open the connection hole 20*g*, as shown in FIG. 6, the pressure members 25, each of which is provided with one end connected to the cap hinge shaft 24*a* of the cap 24, are rotated in cooperation with the cap 24. Then, the pressure parts 25*a*, each of which is formed at the other end of each of the pressure members 25, push the upper parts of the guides 13, thereby rotating the guides 13. Since the reception recesses 13*c* provided on the guides 13 face downwards according to rotation of the guides 13, the interlocking protrusions 23*a* seated in and supported by the reception recesses 13*c* are not supported by the guides 13 any more. Therefore, the interlocking levers 23 and the shutter 22 are rotated around the shutter hinge shaft 22*a* provided with one end, at which the shutter 22 is provided, due to self-weights thereof, and the other end of the shutter 22 is supported by the support protrusion 20*h* provided on the lower end of the first inlet 20*a* of the dust collection unit 20. Therefore, the first inlet 20*a* is closed by the shutter 22.

When suction force generated from the external instrument V is transmitted to the first storage part 20*d* and the second storage part 20*e* provided in the dust collection unit 20 through the connection hole 20*g* under the condition that the first inlet 20*a* is closed by the shutter 22, the shutter 22 is slightly separated from the support protrusion 20*h* provided at the lower end of the first inlet 20*a* by the transmitted suction force, and air is introduced into the first storage part 20*d* through a gap between the shutter 22 and the support protrusion 20*h*.

Here, the air introduced into the first storage part 20*d* is guided to the lower portion of the first storage part 20*d* by the lower end of the shutter 22 and the support protrusion 20*h*. Then, the air flows along the lower surface of the first storage part 20*d*, suspends the foreign substances stacked on the lower surface of the first storage part 20*d*, and then is inhaled together with the suspended foreign substances into the external instrument V.

Further, since the air is introduced into the first storage part 20*d* through the narrow gap between the shutter 22 and the support protrusion 20*a*, the air inhaled into the first storage part 20*d* passes through the first storage part 20*d* and is inhaled to the external instrument V at a high velocity. Therefore, the foreign substances in the first storage part 20*d* are effectively inhaled together with the air flowing at the high velocity to the external instrument V.

After removal of the foreign substances from the dust collection unit 20 through the external instrument V has been completed, when the cap 24 is rotated and closes the connection hole 20*g*, the pressure members 25 are rotated in cooperation with rotation of the cap 24, and thus the force applied to the guides 13 by the pressure members 25 is released. The guides 13 are rotated and returned to their original positions by the elastic restoring force of the restoring springs 14, and then move the interlocking protrusions 23*a* and rotate the interlocking levers 23. Thereby, the shutter 22 is rotated, thus closing the first inlet 20*a*, as shown in FIG. 5.

As is apparent from the above description, in a cleaning apparatus in accordance with one embodiment of the present invention, as a dust collection unit is separated from a main body, a shutter closes an inlet, thereby preventing foreign substances from pouring out of the dust collection unit through the inlet.

Further, as a cap for connection with an external instrument is rotated and opens a connection hole, the shutter closes the inlet, and when suction force from the external instrument is transmitted to the shutter, the shutter is slightly separated from a support protrusion, and air is inhaled through a narrow gap between the shutter and the support protrusion and passes through a storage part and is inhaled to the external instrument V at a high velocity, thereby effectively removing foreign substances in the storage part.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A cleaning apparatus comprising:

a main body;

a dust collection unit detachably installed on the main body and provided with at least one inlet, through which foreign substances is introduced into the dust collection unit;

a shutter to open and close the at least one inlet;

guides to guide opening and closing of the at least one inlet by the shutter in cooperation with whether or not the dust collection unit is attached to or detached from the main body; and interlocking levers, each of which is provided with one end connected to the shutter and the other end having an interlocking protrusion guided by each guide, rotated together with the shutter.

2. The cleaning apparatus according to claim 1, wherein the shutter is hinged to one side of the at least one inlet of the dust collection unit, and is rotated to open and close the at least one inlet.

3. The cleaning apparatus according to claim 1, wherein a guide plane inclined in a direction of attaching and detaching the dust collection unit to and from the main body to guide the interlocking protrusion is provided on each guide.

4. The cleaning apparatus according to claim 1, further comprising a connection hole provided on the dust collection unit, to which an external instrument is connected, and a cap to open and close the connection hole, wherein the cap is provided with one end hinged to the dust collection unit, and is rotated to open and close the connection hole.

5. The cleaning apparatus according to claim 4, wherein the guides are rotatably installed on the main body, and are rotated to support the interlocking protrusions.

6. The cleaning apparatus according to claim 5, further comprising pressure members, each of which is provided with one end connected to a cap hinge shaft provided on the cap, rotated together with the cap to apply pressure to the guides so as to rotate the guides.

7. The cleaning apparatus according to claim 5, further comprising restoring springs installed on guide hinge shafts to rotatably install the guides on the main body, and restoring the guides to their original positions.

8. The cleaning apparatus according to claim 1, wherein a reception recess to receive and support the interlocking protrusion guided by the guide plane is provided at one side of the guide plane of each guide.

9. The cleaning apparatus according to claim 1, wherein:

the dust collection unit includes a first storage part to collect relatively large foreign substances, a second storage part to collect relatively small foreign substances, a first inlet through which foreign substances are introduced into the first storage part, and a second inlet through which foreign substances are introduced into the second storage part; and the shutter opens and closes the first inlet.

10. The cleaning apparatus according to claim 9, wherein the dust collection unit further includes a support protrusion provided at the lower end of the first inlet to support the lower end of the shutter and to guide, in cooperation with the shutter, air, introduced into the first storage part through the first inlet, to the lower portion of the first storage part.

11. A cleaning apparatus comprising:

a main body;

a dust collection unit detachably installed on the main body and provided with at least one inlet a shutter to open and close the at least one inlet;

guides, each of which includes a guide plane to guide rotation of the shutter, rotatably installed on the main body; and interlocking levers, each of which is provided with one end connected to a shutter hinge shaft provided on the shutter and the other end having an interlocking protrusion guided by the guide plane, rotated together with the shutter.

12. The cleaning apparatus according to claim 11, further comprising a connection hole provided on the dust collection unit, to which an external instrument is connected, and a cap to open and close the connection hole, wherein the cap is hinged to one side of the connection hole of the dust collection unit and is rotated to open and close the connection hole, and the shutter is hinged to one side of the at least one inlet of the dust collection unit and is rotated to open and close the at least one inlet.

13. The cleaning apparatus according to claim 12, further comprising:

pressure members, each of which is provided with one end connected to a cap hinge shaft provided on the cap, rotated together with the cap to apply pressure to the guides so as to rotate the guides.

14. The cleaning apparatus according to claim 11, wherein:

the dust collection unit includes a first storage part to collect relatively large foreign substances, a second storage part to collect relatively small foreign substances, a first inlet through which foreign substances are introduced into the first storage part, and a second inlet through which foreign substances are introduced into the second storage part; and the shutter opens and closes the first inlet.

15. A cleaning apparatus comprising:

a main body;

a dust collection unit detachably installed on the main body, the dust collection unit including at least one inlet to collect foreign substances;

a brush unit to sweep the foreign substances to the inside of the dust collection unit through the at least one inlet;

a shutter to open and close one of the at least one inlets;

guides, each of which includes a guide plane to guide rotation of the shutter, rotatably installed on the main body; and interlocking levers, each of which is provided with one end connected to a shutter hinge shaft provided on the shutter and the other end having an interlocking protrusion guided by guide plane, rotated together with the shutter.

16. The cleaning apparatus according to claim 15, wherein the at least one inlet includes a first inlet through which the foreign substances swept by a brush unit are introduced into the dust collection unit, and a second inlet through which suspended particles of the foreign substances are introduced into the dust collection unit together with air, the second inlet being provided above the first inlet in parallel with the first inlet, an inner space of the dust collection unit is divided into a first storage part connected with the first inlet, and a second storage part is connected to the second inlet, and a filter to filter out the foreign substances from the air is disposed in the second storage part.

17. The cleaning apparatus according to claim 16, further comprising a connection hole provided on the dust collection unit, to which an external instrument is connected, and a cap to open and close the connection hole, wherein the cap is hinged to one side of the connection hole of the dust collection unit and is rotated to open and close the connection hole, and the shutter is hinged to one side of the first inlet of the dust collection unit and is rotated to open and close the first inlet.

18. The cleaning apparatus according to claim 17, further comprising:

pressure members, each of which is provided with one end connected to a cap hinge shaft provided on the cap, rotated together with the cap to apply pressure to the guides so as to rotate the guides.

* * * * *

UNITED STATES PATENT AND TRADEMARK OFFICE

CERTIFICATE OF CORRECTION

PATENT NO. : 8,438,694 B2
APPLICATION NO. : 12/801309
DATED : May 14, 2013
INVENTOR(S) : Dong Won Kim et al.

It is certified that error appears in the above-identified patent and that said Letters Patent is hereby corrected as shown below:

Title Page, item [75] (Inventors), Line 10, Delete "Gangju" and insert -- Gwangju --, therefor.

In the Claims:

In Col. 8, Line 40, In Claim 15, delete "inlets;" and insert -- inlet; --, therefor.

Signed and Sealed this
Eighth Day of October, 2013

Teresa Stanek Rea
*Deputy Director of the United States Patent and Trademark Office*